US006221310B1

(12) United States Patent
Checketts et al.

(10) Patent No.: US 6,221,310 B1
(45) Date of Patent: Apr. 24, 2001

(54) SYSTEM FOR EXTRACTING SODIUM METAL FROM SODIUM HYDROXIDE WITH METHANE AS A REDUCTANT

(75) Inventors: Jed H. Checketts; Kent E. Hatfield, both of Salt Lake City; Ramaswami Neelameggham, South Jordan, all of UT (US)

(73) Assignee: Powerball Industries, Inc., Salt Lake City, UT (US)

( * ) Notice: Subject to any disclaimer, the term of this patent is extended or adjusted under 35 U.S.C. 154(b) by 0 days.

(21) Appl. No.: 09/350,385

(22) Filed: Jul. 9, 1999

(51) Int. Cl.[7] ..... C22B 26/10
(52) U.S. Cl. ..... 266/48; 266/153; 266/268
(58) Field of Search ..... 266/268, 153, 266/48

(56) References Cited

U.S. PATENT DOCUMENTS

| | | | | |
|---|---|---|---|---|
| 342,897 | | 6/1886 | Castner | 75/590 |
| 380,775 | | 4/1888 | Thowless | 75/590 |
| 380,776 | | 4/1888 | Thowless | 266/153 |
| 460,985 | | 10/1891 | Netto | 75/590 |
| 2,391,728 | * | 12/1945 | McConica, III et al. | 75/590 |
| 2,642,347 | | 6/1953 | Gilbert | 48/216 |
| 2,685,346 | | 8/1954 | Deyrup et al. | 420/570 |
| 2,774,663 | * | 12/1956 | Kirk | 75/590 |
| 2,930,689 | | 3/1960 | McGriff | 426/558 |
| 3,823,014 | * | 7/1974 | Chong | 75/590 |
| 4,455,176 | * | 6/1984 | Fuhrhop | 266/48 |

FOREIGN PATENT DOCUMENTS 603825 12/1924 (FR) .

* cited by examiner

*Primary Examiner*—Roy King
*Assistant Examiner*—Tima McGuthry-Banks
(74) *Attorney, Agent, or Firm*—M. Reid Russell

(57) ABSTRACT

A reactor system that includes a reactor nozzle for use with a reactor vessel and process for its use for producing sodium metal, by a reaction of an alkali hydroxide, preferably sodium hydroxide, as a reactant, with methane gas as a reductant, at high heat. The invention includes heating apparatus therewith for supplying heated sodium hydroxide and methane gas along with oxygen or compressed air to a reactor nozzle that sprays the materials therethrough to provide a breakup of the materials into fine particulates with mixing thereof in a burner area or portion of a reactor vessel wherein a heated area is provided to cause a reaction of the sodium hydroxide and methane, producing sodium metal vapors along with carbon monoxide and hydrogen gases, which vapors and gases are then passed to a quench assembly that cools the vapor and gas flow to below the condensation temperature of sodium, causing sodium metal to condense therefrom and pass to a storage tank for later use, with the carbon monoxide and hydrogen gases vented therefrom. The quench assembly includes first and second quench coolers that sequentially receive, and in stages cool, the vapor and gas flow with the produced sodium metal to enter the storage tank below the sodium metal level therein with the storage tank further including a volume of a liquid having a lesser specific gravity than, and is non-reactive with, sodium metal for prohibiting a back reaction of the sodium metal.

13 Claims, 3 Drawing Sheets

SYSTEM FOR EXTRACTING SODIUM METAL FROM SODIUM HYDROXIDE WITH METHANE AS A REDUCTANT

BACKGROUND OF THE INVENTION

1. Field of the Invention

A system, apparatus and process for practice for the reduction of sodium hydroxide with natural gas in the presence of heat to produce, after quenching, sodium metal as a product of the thermodynamic reaction.

2. Prior Art

The invention is in a system and apparatus for practicing a process where separate flows of a heated liquid sodium hydroxide, oxygen and heated methane are sprayed through a mixing nozzle to strike one another and mix for burning in a burner area of a reactor vessel, with vaporous sodium metal, carbon monoxide and hydrogen gases, the product of that burning that is passed from the reactor vessel for quenching to rapidly cool and liquify the sodium into metal that is then passed to a storage vessel with the carbon monoxide and hydrogen gases passed for discharge or recycling in the system.

Apparatus and processes for refining sodium metal are old in the art, with a recent U.S. patent application Ser. No. 09/262,876 filed Mar. 5, 1997, by one of the inventors being an example of a new system to include a reactor vessel wherein a heated mixture of sodium hydroxide and methane is provided to vaporize the mix into sodium metal vapors, carbon monoxide and hydrogen gas, which mix is then quenched to separate out the liquid sodium metal from the gases, with the liquid sodium then passed for use. Unique therefrom, the present invention provides a nozzle arrangement for spraying separate flows of heated sodium hydroxide, oxygen and methane together in a burner area of a reactor vessel creating a chemical reaction that produces a sodium metal vapor, and carbon monoxide and hydrogen gases, which mix is passed to a quench chamber wherein vaporized sodium metal is condensed to a liquid that is drawn off for use.

Very earlier apparatus and processes are shown in U.S. Pat. No. 342,897 to Castner; U.S. Pat. Nos. 380,775 and 380,776 to Thowless; and U.S. Pat. No. 460,985 to Netto, as examples of systems that utilize a carbonaceous material as a reactive agent, usually carbon in powder form, that is to react with the compound containing sodium or potassium in the presence of high heat to produce free sodium. Such processes have, however, not only required that a number of complex steps be performed to finally produce sodium metal and, unlike the invention, they have generally been single batch processes only.

Additionally, a French Patent No. 603,825, shows sodium metal being reacted with iron in powder form by first vaporizing the mix and then condense out sodium vapor at temperatures below the sodium condensation temperature. Such process has, however, required that it be conducted in a vacuum and that sodium vapors as are produced be removed from a reaction zone and condensed. Further, in the '825 patent, like a later U.S. Pat. No. 2,642,347 to Gilbert, sodium metal vapor is produced from a condensation of sodium carbonate that has been reacted with carbon at a heat of from 1000 degrees C to 1200 degrees C, which vaporization takes place after the sodium metal vapor has been conducted away from the reaction. Condensation in the Gilbert '347 patent utilizes surfaces of steel balls that are maintained at a temperature below that required for sodium vaporization, with vapor contact with the steel ball surfaces condensing sodium metal. The above cited systems are each essentially a batch system, unlike the present invention, that is a continuous system where sodium metal is produced in liquid form and is continuously drawn from a bottom vessel of a quench chamber, and neither involves a use of sodium hydroxide and methane as reactants. Nor do the either of the systems of these patents proved, as does the invention, a novel mixing spray nozzle that directs individual flows of the heated reactants against one another to break the flows into fine particulates, mixing them together in a high heat atmosphere, to react and produce vaporous sodium metal, and carbon monoxide and hydrogen gasses, with the mix then quenched to liquify sodium metal that is then removed for use. With such quenching taken place in a vessel or vessels that maintain a cooled surface, such as a coil receiving a coolant liquid passed therethrough and/or may include spraying of a non-reactive coolant into the vaporous mix as it enters the quench cooler, which quenching condenses out sodium metal from the reactant vapors that is then drained into a storage vessel.

A U.S. Pat. No. 2,930,689 to McGriff teaches a submerged combustion of methane in molten sodium carbonate and includes a separation wall to prevent the combustion gases, water and carbon dioxide, from entering into the reaction of methane or carbon with sodium carbonate. The McGriff process requires an operating temperature of from 1150 to 1250 degrees C, with carbon or methane fed into the hot sodium carbonate, and with sodium carbonate continuously added. The process requires a continuous addition of carbon, preferably coke in powdered form, to perpetuate the reaction. In practice, handling of a solid material, such as carbon, is a disadvantage that is not present in a practice of the invention. Further, McGriff '689 does not include a mixing nozzle or quenching arrangement like that of the present invention, but provides for an immediate reaction at high heat to produce vaporous sodium metal like that of the invention.

While McGriff '689, like the invention, teaches a use of methane as one of the reactants for producing sodium metal, that production is from a molten sodium carbonate, and further, unlike the invention, it requires that carbon, in powdered form, be continuously passed into the reaction vessel. Also, unlike the invention, the McGriff '689 patent provides for burning of the introduced methane producing a high heat in the presence of carbon, with methane fed into hot sodium carbonate and with carbon, as solid coke in powdered form, continuously added for the reaction to proceed. Further the McGriff '689 patent does not deal with problems inherent in quenching sodium metal from a mix of gaseous carbon monoxide (CO) and sodium (Na), and fails to recognize and deal with a back reaction as will occur as the gases cool where sodium metal tends to react with carbon monoxide to produce sodium carbonate ($Na_2CO_3$), which problem of back reaction the invention addresses and solves.

Further, a patent to Deyrup, U.S. Pat. No. 2,685,346, like the invention, incorporates a step of quenching of a hot vapor containing a free alkaline metal to cool the alkaline metal to a molten state, and deals with a handling of a back reaction as the sodium vapor is quenched from the carbon monoxide and sodium gases. Unlike the invention, however, the Deyrup '346 patent involves a use of large amounts of tin, must be operated at high temperatures, and, of course, does not involve a mixing spray nozzle arrangement like that of the invention. Also, the Deyrup '346 patent teaches a multi-step process to provide for a quenching of the sodium metal and accordingly, in its operation, it is likely that a large percentage of the collected sodium metal will be lost to back reaction, and further the system of the Deyrup '346 patent is not continuous.

SUMMARY OF THE INVENTION

It is a principal object of the present invention to provide a system, apparatus and process for separating out sodium metal from a mixture of heated sodium hydroxide as a reactant with the sodium hydroxide, heated methane and oxygen sprayed together through a single nozzle apparatus into a high heat area of a reactor vessel to produce metal sodium in a vapor state along with carbon monoxide and hydrogen gases, with the vapor and gaseous mix then quenched to liquify sodium metal that is drawn off for use.

Another object of the present invention is to provide a system, apparatus and process for continuously producing sodium metal from a reaction of heated sodium hydroxide as the reactant with methane as a reductant in the presence of oxygen to produce high heat in a reactor vessel, forming a vapor and gaseous mix of sodium metal, carbon monoxide and hydrogen that is then rapidly quenched to produce liquid sodium metal, with carbon monoxide and hydrogen as off gases that are exhausted to atmosphere or are recycled into the system.

Another object of the present invention is to provide an nozzle apparatus and process to produce, from a reaction of hot sodium hydroxide as a reactant with methane as a reductant in the presence of oxygen combined as a mixture and injected into a reactor vessel burner zone to produce a temperature that is well above the vaporization temperature of sodium metal of approximately two thousand (2,000) to twenty-eight hundred (2800) degrees F., to vaporize sodium metal from the mixture and form carbon monoxide and hydrogen gases, the sodium metal vapors and gases to pass to a quench chamber for rapid cooling, precipitating sodium metal from the flow that is collected and passed from the quench unit for processing, with the gases passed for venting or recycling.

Another object of the present invention is to provide, for practicing the process of the invention, a quench apparatus arranged as primary and secondary, or first and second chambers that operate in series to receive and, in passage of the vapor and gaseous mix, to cool the mix to below the condensation temperature of sodium metal, condensing out sodium metal while discouraging a back reaction of the sodium metal.

Still another object of the present invention is to provide, in a quenching apparatus of the invention, for performing a rapid cooling of the vaporized and gaseous mix constituents, that is a two stage first and second vessel arrangement provided to efficiently precipitate of essentially all the available sodium metal from the vaporous and gaseous mix.

Still another object of the present invention is to provide a simple spray nozzle for spraying separate flows of the constituents of heated sodium hydroxide, methane and oxygen from the single nozzle that directs the flows together creating fine thoroughly mixed particulates in a burner portion or section of a reactor vessel, providing a rapid reaction of the constituents at high heat to form a flow of sodium metal vapors, and carbon monoxide and hydrogen gases, with that flow then passed through first and second quench chambers that cool the flow to condense sodium metal.

Still another object of the present invention is to prevent a back reactor of the condensed sodium metal during a continuous production of liquid sodium metal that can then drawn from the quench vessel as a continuous process.

Still another object of the present invention is to provide a reactor vessel and process for practice therein to efficiently produce sodium metal that is essentially automated and, except for a close monitoring or temperatures and pressures in a reactor vessel, requires little human involvement in a continuous refining of sodium metal from a liquid sodium hydroxide.

The system, apparatus and process of the invention is for processing sodium hydroxide (NaOH) as a reactant that is combined with, in a preferred embodiment, methane gas or other appropriate combustible hydrocarbon as a reductant, and reducing the mixture by high heat in the presence of oxygen to produce a combined flow of vaporized sodium metal and carbon monoxide and hydrogen gases. The system and apparatus includes a reactor nozzle wherethrough are simultaneously passed, preferably, separate flows of heated sodium hydroxide and methane and oxygen, with the nozzle directing the flows therefrom to impinge upon and mix with one another, forming fine particulates within a burn area of a reactor vessel, with the constituents in the combined flows immediately reacting producing vaporous sodium metal from the mix and forming carbon monoxide and hydrogen gasses. The sodium metal vapors and gases are then passed to a first of two quench coolers that, preferably, also receives a flow of a coolant liquid that is non-reactive with sodium metal directed therein, and thence to a second to further reduce the temperature of the vaporous and gaseous mix, to precipitate sodium metal therefrom. A back reaction of the liquid sodium metal to sodium carbonate ($Na_2CO_3$) is discouraged by the injection of the coolant liquid and the speed of quenching and, along with the presence of an inert gas, preferably nitrogen, in the reactor vessel and quench cooler. The sodium metal is then passed to a holding vessel that contains a material that is non-reactive with and is lighter than sodium metal to float thereon that is preferably the coolant liquid as passed to the first quench cooler that is circulated from the holding vessel to the first quench cooler. The sodium metal is thereby contained in a non-reactive state until it is drawn off for use. The system is operated as a continuous process, with the temperature in the top or burner zone of the reaction vessel wherein the sodium hydroxide, oxygen and methane are sprayed from the single nozzle, maintained at from two thousand (2,000) to twenty eight hundred (2,800) degrees F., preferably approximately twenty-five hundred (2,500) degrees F., with the reaction to produce sodium metal, along with carbon monoxide and hydrogen gases taking place at approximately nineteen hundred (1,900) degrees F. The quenching process is preferably conducted in an inert atmosphere and at less than atmospheric pressure, minimizing the number of molecules as are present as could react with the sodium metal causing a back reaction producing sodium carbonate. In a practice of the process of the invention, the process constituents consisting of flows of heated sodium hydroxide and methane along with oxygen are separately and continuously passed through the nozzle of the invention, spraying against one another to mix and form fine particulates in a burner portion of the reactor vessel wherein a flame area is maintained. An immediate reaction thereby takes place that produces vaporous sodium metal along with carbon monoxide and hydrogen gases that are then passed to a quench assembly for rapid cooling. Sodium metal is thereby produced, with the carbon monoxide and hydrogen gases vented as waste or are for passed recycling to be burned for heating, as desired. Sodium hydroxide that is the reactant in a practice of the process of the invention may be a waste product, as is produced in a number of commercial processes, or may be supplied from any number of sources.

BRIEF DESCRIPTION OF THE DRAWINGS

In the drawings that illustrate that which is presently regarded as the best mode for carrying out the invention.

DETAILED DESCRIPTION

Figure 1:
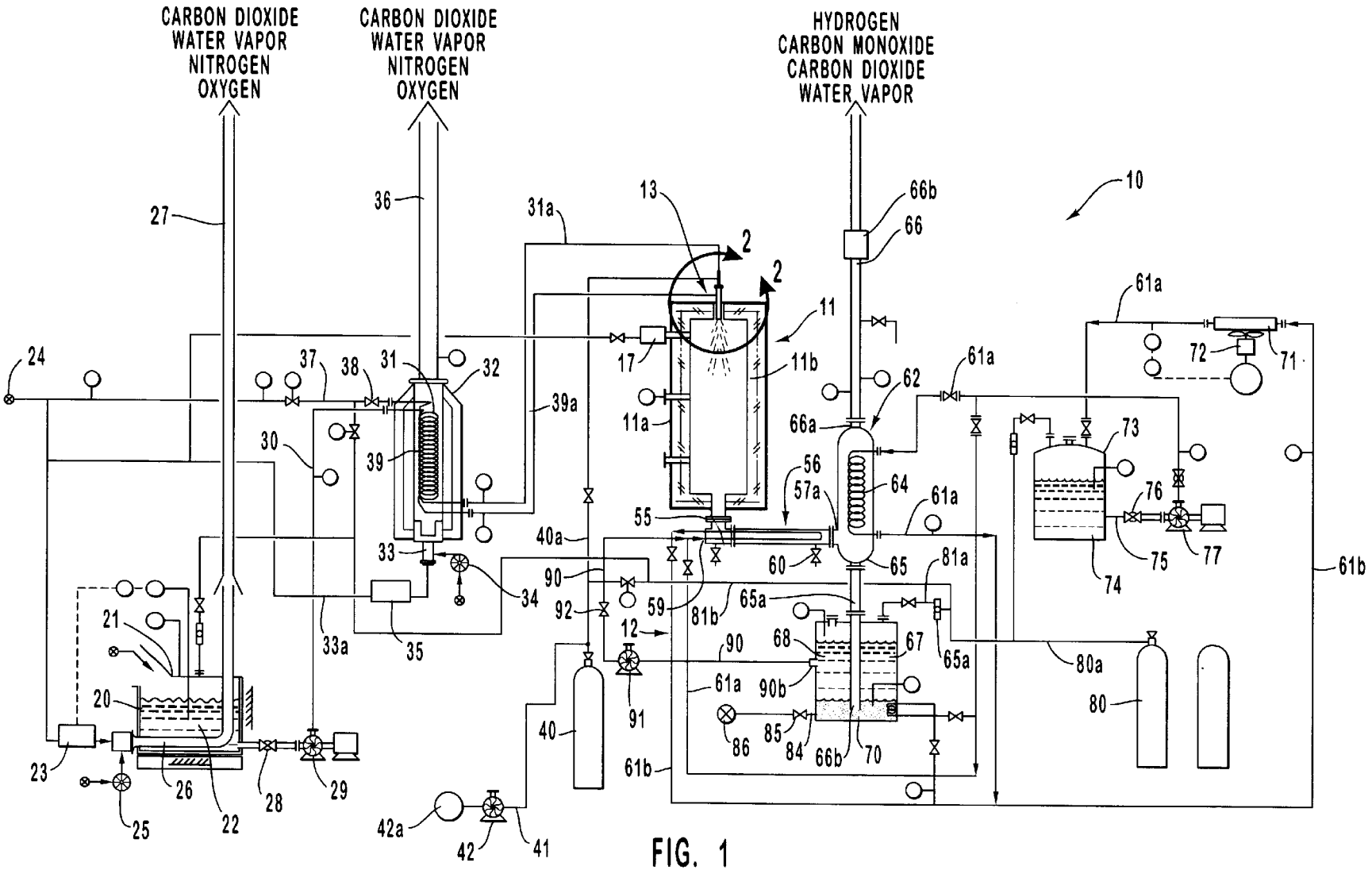
FIG. 1 is a schematic of a sodium metal production facility of the invention where sodium metal is produced in a reaction of heated sodium hydroxide with heated methane in an oxygen environment and at a high heat, where the reaction constituents are separately sprayed from a single nozzle that directs the sprays against one another, forming a flow of well mixed fine particles within a burner area of a reactor vessel, thereby cracking the mixture to produce vaporous sodium metal along with carbon monoxide and hydrogen gases, with the vapor and gases then passed for rapid cooling in a two stage quenching apparatus, wherein sodium metal is condensed from the mix and is passed to a storage vessel wherein it is maintained beneath a non-reactive material to discourage any back reaction until drawn therefrom for use.

FIG. 1 shows a schematic of a plant 10 for refining sodium metal from a reactant of sodium hydroxide with, preferably, methane as a reductant in the presence of oxygen at a high or cracking heat in a reactor vessel 11, shown herein as a cylinder, through it should be understood, another shape of vessel could be so used, to vaporize sodium metal from the constituent mix, and with the sodium metal then condensed from a vaporous and gaseous mix in a quench assembly 12.

Figure 2:
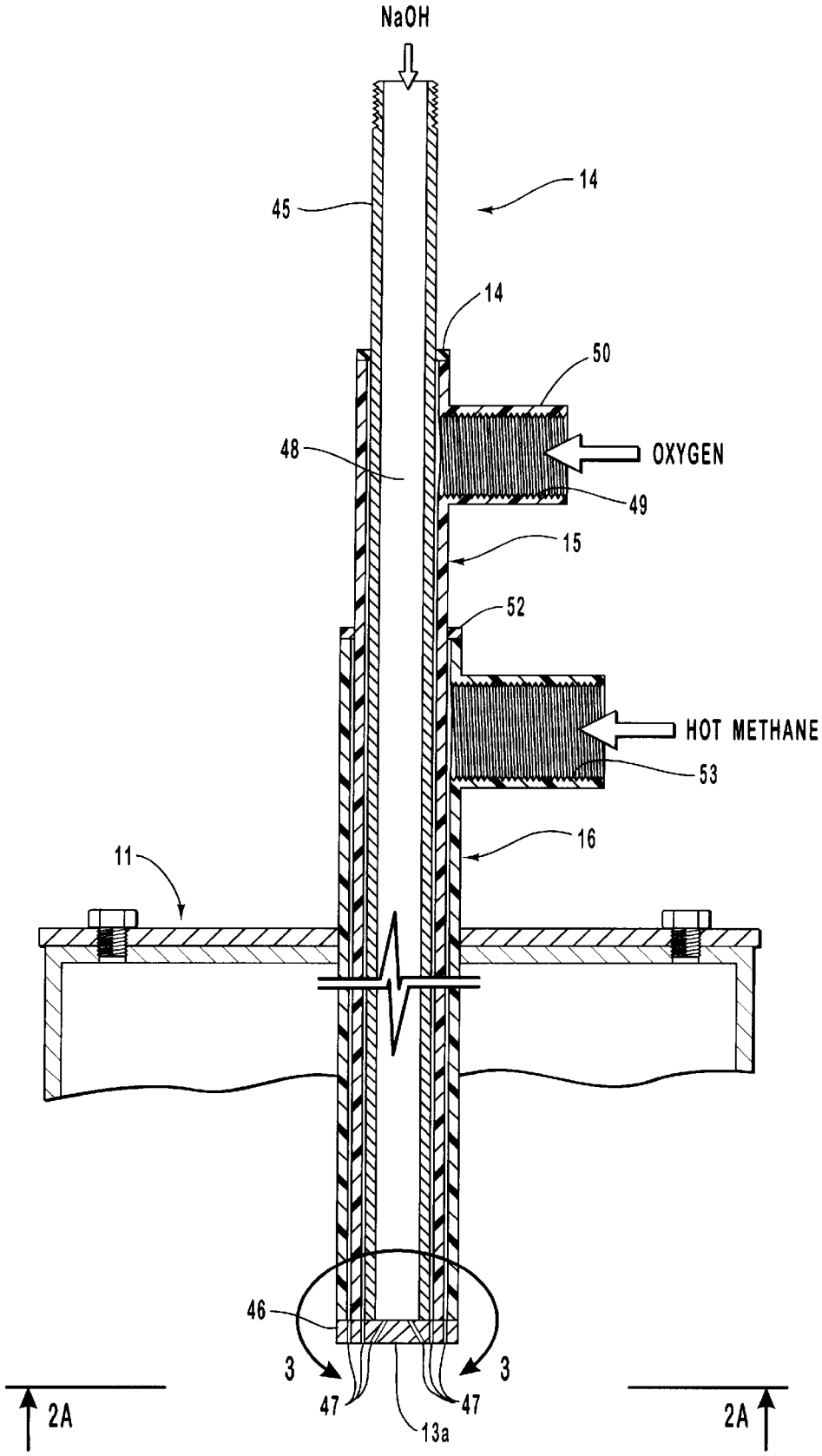
FIG. 2 is an enlarged sectional view taken along the line 2—2 of FIG. 1 of the reactor nozzle of the invention.
Figure 2A:
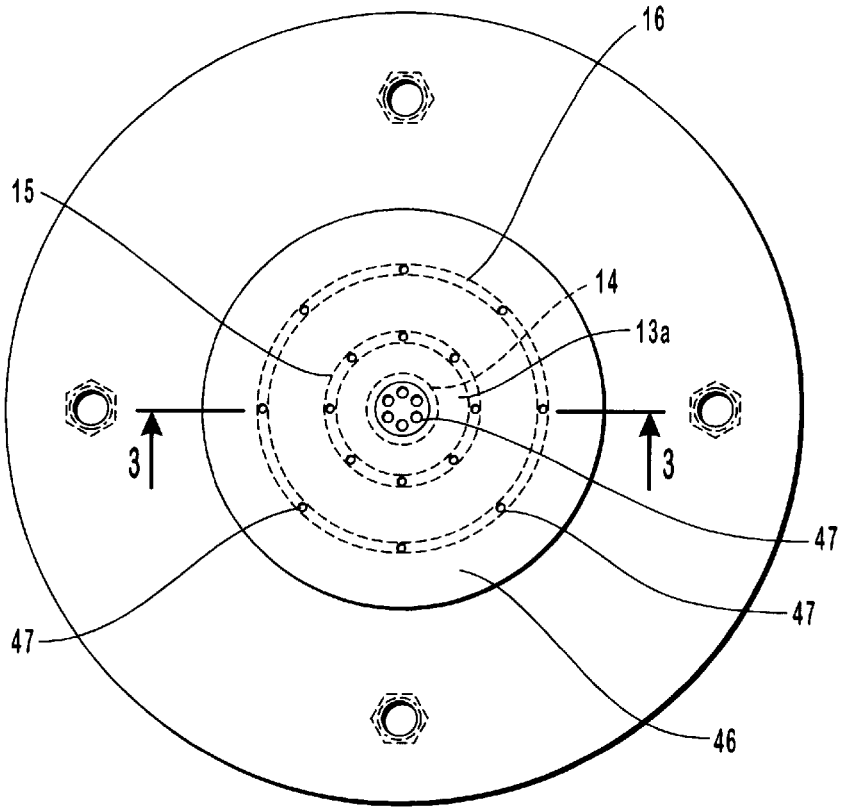
FIG. 2A shows a lower end plan view of the reactor nozzle of FIG. 2.
Figure 3:
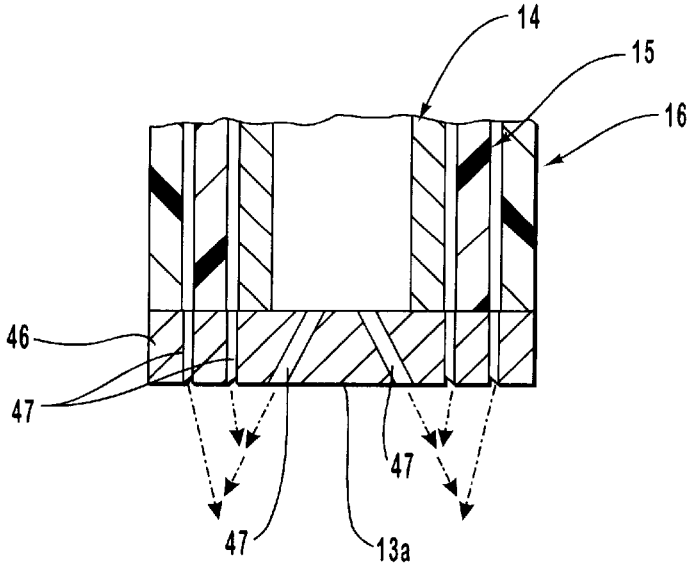
FIG. 3 shows an enlarged end view of the end of the nozzle of FIG. 2 showing the reactive materials being sprayed out of the nozzle end, striking one another forming fine mixed particles that provide a large surface area for reaction.

In the schematic of FIG. 1, the plant includes a single reactor vessel 11 along with a pair of separate serially connected chambers or coolers as the quench assembly 12. The reactor vessel 11, as shown in the drawings, incorporates a reactor nozzle 13 that is configured to have three separate longitudinal passages 14, 15 and 16, respectively therethrough, with the individually passages for transporting, respectively, a sodium hydroxide solution that has been heated to approximately two thousand (2,000) degrees F. through the center passage 14; with oxygen gas passed through the middle passage 15; and with methane gas that has been heated to approximately fifteen hundred (1,500) degrees F. through the outer passage 16, as shown in FIGS. 2 and 3. It should, however, be understood that, in practice, the oxygen flow can be a compressed air flow within the scope of this disclosure and can be combined with the sodium hydroxide flow, allowing for a use of a reactor nozzle 13 having only a center passage 14 and an outer passage 16, within the scope of this disclosure and further than a hydrocarbon other than methane can be utilized as the reductant within the scope of this disclosure. The liquid and gaseous mix is thereby injected into a top section 11*a* of the reactor vessel 11 and into a burner area of the reactor vessel that receives a burnable material, preferably methane or natural gas, through a gas pilot 17 that extends into the vessel top section 11*a* or burner portion that is ignited to produce a hot fire, though another burnable material can be so used, or even an electric furnace arrangement can be so employed within the scope of this disclosure. So arranged, the oxygen flow that is injected through passage 15 promotes a high heat of burning in the top section 11*a* or burner portion that receives the heated fine particulate mixture of sodium hydroxide and methane and oxygen, providing a rapid temperature to the mixture to increase to approximately between two thousand (2,000) and twenty-eight (2,800) degrees F., to cause an immediate reaction or cracking of the mix into sodium metal vapor and carbon monoxide and hydrogen gases. At this high heat, the reaction will be almost instantaneous and the combined vapor and gaseous mix can then be passed to the quench assembly for rapid cooling, causing the sodium metal vapor to condense to a liquid that can then be drawn off, as set out and discussed in detail hereinbelow.

The plant 10 includes a caustic or sodium hydroxide (NaOH) tank 20 that receives, through a hinged top 21, a supply of caustic sodium hydroxide 22 that is preferable an anhydrous NaOH caustic prills or beads though, it should be understood, such caustic can be a waste product from another manufacturing process, within the scope of this disclosure. A burner 23 receives a high pressure flow of methane gas from a source 24 for burning and directs the burner output, that is mixed with air from a blower 25, through a line 26 that runs through the tank 20, heating the sodium hydroxide 22, to vent, through a line 27, carbon dioxide, water vapor, nitrogen and oxygen. The caustic sodium hydroxide solution is initially heated in tank 20 to approximately seven hundred fifty (750) degrees F. and is then passed therefrom through a valve 28 and is pumped by pump 29 through line 30 into a heating coil 31 that is contained in vessel 32. A burner 33 is mounted in the vessel 32 bottom to receive methane that is fed thereto through a feed line 33*a* that receives the flow of methane from a high pressure methane source 24. The methane gas is mixed with air that is provided through a blower 34 and a burner control 35 provides a desired heat output, with the vessel 32 vented through line 36. After passage of the sodium hydroxide solution through coil 31 it emerges into line 31*a* having a temperature that has been raised to approximately two thousand (2,000) degrees F. Additionally, methane gas, under pressure, is directed through a line 37 to pass through a valve 38 and is directed through a line 39 that parallels the coil 31, to emerge from the vessel 32 as line 39*a* that contains the methane that has been heated to a temperature of approximately fifteen hundred (1,500) degrees F. The respective heated sodium hydroxide solution and methane gas travel through the separate passages through the nozzle 13 and are mixed together by spraying them through an injection plate 46, the flows to strike one another in front of a nozzle face 13*a*, and with oxygen or compressed air provided through a line 41 from a compressor 42 that draws fresh air through an inlet 42*a* that is also directed through the nozzle 13 from a tank 40 and through a line 40*a*, wherein line 41 may be connected as an alternative or to augment the flow of oxygen from tank 40. The respective gases and sodium hydroxide solution are injected under pressure from the reactor nozzle 13 striking one another apart from the nozzle face 13*a*, as set out below.

The reactor nozzle 13 is mounted, as shown in FIG. 1, in the head or top end 11*a* of the reactor vessel 11 that preferably has ceramic walls 11*b*, as the vessel liner, that will withstand the effects of the high heat atmosphere therein along with the effects of the heat stimulated reaction of the heated caustic solution and methane that produces a rapid vaporization of sodium metal, and the ceramic vessel walls are non-reactive with sodium metal to prevent any unwanted back reaction of the vaporized sodium metal to form sodium carbonate ($Na_2CO_3$). The reactor nozzle 13 provides for separated passage of the heated methane and sodium hydroxide solutions along with oxygen or compressed air for mixing these constituents in front of its injection end 13*a*, as shown in FIGS. 2 and 3. Preferably, the sodium hydroxide passage 14 is a center tube or pipe 45 that is open the length thereof and has its injection end covered with an injection plate 46 wherein a plurality of spaced holes or perforations 47 are formed, that pass the separate sodium hydroxide methane and oxygen flows. The spaced holes or perforations 47 act as nozzles for directing sodium hydroxide, methane and oxygen or compressed air sprays under pressure therethrough to impinge or strike one another so as to cause both a break up of the sprayed constituents into fine particulates and turbulence to thoroughly mix the respective flows together in the high heat environment as is present at the top 11*a* of the reactor vessel 11. The combined fine particulate constituents provide a large surface area that will rapidly be heated to provide complete reaction of the sodium hydroxide and methane to form, respectively, sodium metal in vaporous form, along with carbon monoxide and hydrogen gases. The oxygen or compressed air as is passed through a nozzle chamber 48 is to promote combustion in the reactor vessel providing the preferred high heat of between two thousand (2,000) to twenty-eight (2,800) degrees F. and is approximately twenty-five (2,500) degrees F. that, in turn, provides for a rapid reaction or cracking of the constituents in the flows, producing sodium metal. Further, where compressed air is so used, a large volume of nitrogen (N) is thereby present that is, of course, inert and prevents an undesired back reaction of the sodium metal vapors into sodium carbonate ($Na_2CO_3$).

The reactor nozzle 13, in addition to its center pipe 45, includes an inner sleeve 48 having an open annular space along its length, is closed across its upper end at 49 and includes a feed port 50 whereto the line 40*a* from the oxygen or compressed air source is connected. Oxygen or compressed air is passed through the feed port 50 and flows between the pipe 45 carry the heat sodium hydroxide solution and outer sleeve 51 that transports the heated methane with the oxygen or compressed air flow thereby heated by the pipe 45 and sleeve 51 walls which oxygen or compressed air flow is passed through holes or perforations 47 in the injection plate 46, spraying into the sprays of sodium hydroxide and methane which sprayed flows are thereby broken into fine particulates with the fine particles presenting a large reaction surface and are thoroughly mixed with the oxygen presence to promote a rapid heating of the mixed flows in the flame area at the top 11*a* of reactor vessel 11 producing a rapid reaction or cracking. The reactor nozzle 13 further includes the outer sleeve 51 that has an open annular cavity therealong, is closed across its top end 52 and includes a feed port 53 whereto is connected line 39*a*. Heated methane gas or other suitable hydrocarbon, such as heating oil, propane ($C_2H_6$), or the like is passed from line 39*a* through feed port 53 to travel through the outer sleeve annular cavity and out the holes or perforations 47 formed in the injection plate, spraying therefrom into engagement with the sprays of sodium hydroxide and oxygen or compressed air, so as to thoroughly mix therewith and react with the sodium hydroxide in the high heat atmosphere. In FIG. 3 is shown the respective sprays as are sprayed out from holes or perforations 47 impinge or strike one another, providing fine thoroughly mixed flow of particles.

In FIG. 1 the sprays from reactor nozzle 13 are shown sprayed into the top area 11*a* of the reactor vessel 11. A fuel flow is passed through the gas pilot 17 and is ignited within the top area 11*a* to provide a flame or burner area that receives the sprays from reactor nozzle 13. So arranged, an immediate reaction of the sodium hydroxide and methane will take place in the reactor vessel top area 11*a*, forming vaporized sodium metal and carbon monoxide and hydrogen gases by the reaction:

$$CH_4+NaOH \rightarrow CO+Na+2.5H_2$$

The vapor and gaseous mix are then passed from the reactor vessel 11 through a bottom vent 55 and into an inlet 57 of a first quench cooler 56 of the quench assembly 12.

The first quench cooler 56, as shown in FIG. 1, is a hollow vessel, identified as a tube or cylinder 58 though another shape of vessel could be so used, that connects at a vapor and gas inlet 57, to bottom vent 55 of the reactor vessel to pass the flow from that reactor vessel 11 and into the cylinder 58. The cylinder 58 is closed across end 59 wherethrough inlet and exhaust coolant lines 61*a* and 61*b*, respectively are passed that connect into a chill coil 60 that is positioned within an open longitudinal center area of the cylinder 58. Further, which cylinder 58 and end 59 adjacent to vapor and gas inlet 57, can be connected to a spray end 90*a* of an inert fluid flow line 90 that connects at 90*b* into a liquid sodium tank 67 to drain an inert fluid 68 therefrom. So arranged, inert fluid 68 removed from tank 67 is pumped by pump 91 to pass through a valve 92 and be sprayed into the vapor and gaseous flow passed into the first quench cooler 56. This spray of inert fluid 68 to provide, as a direct quench, for an initial cooling of the flow to initially lower the mix temperature and provides for a formulation of an envelope around the individual sodium particles, preventing an unwanted back reaction of sodium into sodium carbonate ($Na_2CO_3$). The chill coil 60 to provide rapid cooling to the vapor and gas flow receives a coolant flow pumped therethrough, creating a cold outer surface that is contacted by the vapor and gas flow from the reactor chamber. So arranged, the vapor and gas flow is initially or further cooled and is then passed through a vent coupling 57*a* to a second quench cooler 62 of the quench assembly 12.

The second quench cooler 62 is also shown as a cylinder 63, though another vessel shape could be so used, and wherein a final chill coil 64 is fitted that is to receive the vapor and gaseous mixture flow thereover, cooling that flow to below the vaporization temperature of sodium metal. So arranged, sodium metal is thereby condensed out of the vapor and gaseous flow to a liquid state and falls through a discharge end 65 of the cylinder 63 to pass through a line 65*a* and into a liquid sodium holding tank 67, shown as a volume 70. In practice, the temperature of the vaporous and gaseous mix within the second quench cooler 62 is reduced to below three hundred (300) degrees F., whereat sodium metal vapors condenses into a liquid, with the carbon monoxide and hydrogen gases as remain in the flow, along with some carbon dioxide and water vapor, then exhausted through a cylinder vent end 66*a* and passed through an exhaust line or stack 66 to atmosphere or to a recycling line for reprocessing and use in a plant system, not shown, as is practical and profitable to the process, within the scope of this disclosure. In which passage through the stack 66 the gases are passed through a flame arrester 66*b* that is to eliminate a possibility of an unwanted ignition of the mix of gases, including the gaseous hydrogen.

Shown in FIG. 1, the line 65*a* extends into the liquid sodium tank 67 to just above the bottom thereof to discharge liquid sodium from the second quench cooler 62 through end 66*b* to below the level of the liquid sodium 70 maintained therein. Further, to maintain the integrity of the sodium metal 70, precluding a back reaction thereof where the sodium metal reacts to form a sodium hydroxide, the sodium metal 70 is covered by a layer of an inert liquid 68, such as kerosene, though other liquid could be so used within the scope of this disclosure. As set out above, the inert liquid 68 preferably kerosene or other appropriate liquid can be drawn out of the liquid sodium tank 67 to serve as an initial coolant for lowering the temperature and encapsulating sodium metal particles in the first quench cooler 56. Such drawing off of inert fluid 68 should be limited so as not to uncover the liquid sodium to with, of course, the inert liquid 68 as is directed into the first quench cooler 56 to return to the liquid sodium tank 67 through the discharge end 65 of the second quench cooler 62.

Like the coolant liquid supplied to the first quench cooler 56, a refrigerant is supplied to and discharged from the second quench cooler 56 through branches of lines 61*a* and 61*b*, respectively, Line 61*a* is connected to a refrigerant flow from a dowtherm cooler 71 that condenses the refrigerant by cooling it, as illustrated by a fan 72, and directs that liquid refrigerant into a surge tank 73. The liquid refrigerant, shown at 75, is then passed through a valve 75 to a pump 76 into the line 61*a* that branches to flow to both the first and second quench coolers 56 and 62. The discharge flow from each quench cooler then flows through branched return lines 61*b*, with line 61*b* connected to an inlet side of the dowtherm cooler 71.

To prohibit the occurrence of a back reaction in the reaction or cracking process as takes place in the reactor vessel, a nitrogen source, shown as a tank 80, is linked through line 80*a* to a manifold 81 that is connected through line 81*a* into the top of sodium holding tank 67 to provide a nitrogen atmosphere above the kerosene 68 level. Further, a branch line 81*b* from the manifold 81 connects into the supply line 40*a* from the oxygen source tank 40 that passes nitrogen therethrough to control the volume of oxygen as is passed through nozzle 13 to a volume to support combustion in the top 11*a* or reactor vessel 11 only, to provide that essentially all of the oxygen as is supplied with the sodium hydroxide and methane into the reactor vessel will be consumed in the combustion taking place there or, as an alternative, with a use of compressed air, the flow into nozzle 13 will contain both oxygen and nitrogen without a need for a separate source of nitrogen gas. Sodium metal 70 is drawn from beneath the level in tank 67 from a discharge line 84, through a valve 85 and pump 86 for use.

Hereinabove has been shown and described a preferred apparatus and system of my invention for producing sodium metal from sodium hydroxide reacted with methane in the presence of a high heat of approximately two thousand (2,000) to twenty-eight hundred (2,800) degrees F. to crack mixed sprays of sodium hydroxide and methane with oxygen alone or with oxygen in compressed air, to produce sodium metal vapors from the reaction sodium metal vapor with carbon monoxide and hydrogen gases, with the sodium metal vapors then condensed into a liquid by a rapid cooling of the vapor and gaseous mix, which sodium metal is then drained off in a continuous process. It should, however, be understood that the present disclosure is made by way of example only and that variations are possible without departing from the subject matter coming within the scope of the following claims and a reasonable equivalency thereof, which subject matter we regard as our invention.

We claim:

1. A system for extracting sodium metal from a reaction of sodium hydroxide and methane gas at high heat comprising, a reactor vessel; separate sources of sodium hydroxide and methane; means for heating each of said separate sources of sodium hydroxide and methane; a reactor nozzle; means for passing said heated sodium hydroxide and methane into first and second passages that are formed in a housing of said reactor nozzle that is fitted into said reactor vessel; a source of oxygen and means for passing said oxygen into said reactor vessel, and which said first and second passages each include an exhaust port that is fitted into a nozzle face and mounts an orifice end therein, and which individual ports receive separate flow of said sodium hydroxide and methane that are transported as separate flows and are sprayed through the orifice ends, which said orifices are formed to individually direct said flows of sodium hydroxide and methane gas against one another, spaced from said reactor nozzle end so as to mix and form sodium hydroxide and methane flows that mix with the oxygen flow passed into said reactor vessel, providing fine particulates; means for providing a heat area within a reaction portion of said reactor vessel where the temperature is from two thousand to twenty eight hundred degrees F, to raise the temperature of the mixture of sodium hydroxide, methane and oxygen particles to where a reaction takes place that produces sodium metal vapors, carbon monoxide and hydrogen gases; means for venting said sodium vapors, carbon monoxide and hydrogen gases to a quench assembly means for cooling said vapor and gaseous mix below the condensation temperature of sodium metal, liquefying sodium metal; means for passing said liquid sodium metal to a sodium metal storage tank; and means for venting said carbon monoxide and hydrogen gases through an exhaust.

2. The system as recited in claim 1, wherein the reactor nozzle housing includes a third passage that is connected to receive the oxygen flow through an entry port means in said reactor nozzle, and said third passage directs said oxygen flow into an orifice in the reactor nozzle end, spraying that flow therefrom to strike and mix with the sprays of sodium and hydroxide and methane.

3. The system as recited in claim 1, further including means for heating the flows of sodium hydroxide and methane prior to their passage into the reactor nozzle.

4. The system as recited in claim 1, wherein the reactor vessel is a cylinder whose interior is lined with fire bricks and wherein is fitted the reactor nozzle, and which said reactor vessel is open to pass a flow of vaporous and gaseous sodium metal, carbon monoxide and hydrogen therethrough into the quench assembly means; and including a means for maintaining an area within said cylinder that receives the mixed sprays of sodium hydroxide and methane and oxygen at a temperature between two thousand and twenty-eight hundred degrees F, causing a reaction of said sodium hydroxide and methane to produce, as reaction products, a discharge flow of hot sodium metal vapors and carbon monoxide and hydrogen gases.

5. The system as recited in claim 4, further including a source of a fluid that is inert to sodium metal; and means for directing said fluid into the quench assembly means and into the discharge flow.

6. The system as recited in claim 5, wherein the fluid is kerosene.

7. The system as recited in claim 4, wherein the quench assembly means includes a first quench cooler having a housing that is open and connects to receive the discharge flow of hot sodium metal vapors and carbon monoxide and hydrogen gases from the reactor vessel, includes a cooling coil means containing a refrigerant media whereover said discharge flow is directed, initially cooling said discharge flow that is then passed through a housing vent end; and a second quench cooler that includes a housing arranged to receive said discharge flow through an inlet end and includes a secondary cooling coil wherethrough a refrigerant media is passed, and whereover said discharge flow is directed, reducing the vapor and gases mixture temperature to below the condensation temperature of sodium metal that thereby is liquified and the liquified sodium metal is directed out of a sodium metal discharge opening in said second quench cooler housing to pass into a sodium metal collection tank, with the remaining carbon monoxide and hydrogen gases passed through a vent stack of said second quench cooler.

8. The system as recited in claim 7, further including a source of nitrogen gas and means for supplying said nitrogen gas into the quench assembly and sodium metal collection tank.

9. The system as recited in claim 8, wherein the nitrogen gas is connected into the line supplying oxygen to the reactor nozzle to maintain a desired oxygen content to support burning in said reactor chamber and be fully consumed therein.

10. The system as recited in claim 7, wherein the refrigerant is maintained in a closed system traveling from a dowtherm cooler to a surge tank wherefrom it is pumped by a pump means through lines connected into the coils of both the first and second quench coolers.

11. The system as recited in claim 1, further including an exhaust line from the sodium metal storage tank that received sodium metal from the quench assembly means and connects below a level of sodium metal in said sodium metal storage tank, and said sodium metal storage tank connects to a line to receive a volume of kerosene therein that floats upon the volume of sodium metal to prohibit a reverse reaction of said sodium metal.

12. The system as recited in claim 1, further including means for cooling the sodium metal vapors and carbon monoxide and hydrogen gas from a temperature of approximately twenty-five hundred degrees F. in the reactor vessel to a temperature of approximately three hundred degrees F. in the quench assembly means.

13. The system as recited in claims 1, wherein sodium hydroxide is heated by passage through a heating coil to a temperature of from thirteen hundred to seventeen hundred degrees F. prior to passage into the reactor nozzle; and the methane is heated in a line that parallels said heating coil to a temperature of from seventeen hundred to twenty-one hundred degrees F. prior to passage into the reactor nozzle.

* * * * *